US007796012B2

(12) United States Patent
Gerstenkorn

(10) Patent No.: US 7,796,012 B2
(45) Date of Patent: Sep. 14, 2010

(54) METHOD OF CONTROLLING ACCESS TO AN AREA ACCESSIBLE BY PERSONS, PARTICULARLY TO A SPACE CLOSED BY A DOOR

(75) Inventor: Bernhard Gerstenkorn, Ebikon (CH)

(73) Assignee: Inventio AG, Hergiswil NW (CH)

( * ) Notice: Subject to any disclaimer, the term of this patent is extended or adjusted under 35 U.S.C. 154(b) by 828 days.

(21) Appl. No.: 11/459,992

(22) Filed: Jul. 26, 2006

(65) Prior Publication Data

US 2007/0024417 A1 Feb. 1, 2007

(30) Foreign Application Priority Data

Jul. 28, 2005 (EP) ..... 05106990

(51) Int. Cl.
*H04B 1/38* (2006.01)

(52) U.S. Cl. ..... 340/5.61; 340/5.2; 340/5.22; 340/5.64; 340/5.1; 455/3.05; 455/410; 455/411; 455/421; 455/41.1; 455/41.2

(58) Field of Classification Search ..... 340/5.2, 340/5.22, 5.61, 5.64, 5.1; 455/3.05, 410, 455/411, 421, 41.1, 41.2
See application file for complete search history.

(56) References Cited

U.S. PATENT DOCUMENTS

2002/0180582 A1* 12/2002 Nielsen ..... 340/5.6
2003/0036355 A1* 2/2003 Gundlach ..... 455/41
2004/0249714 A1 12/2004 Ponert
2007/0033649 A1* 2/2007 Henriksen ..... 726/20

FOREIGN PATENT DOCUMENTS

| | | | |
|---|---|---|---|
| EP | 1 065 637 | A2 | 1/2001 |
| EP | 1 233 378 | A1 | 8/2002 |
| EP | 1 065 637 | A3 | 8/2003 |
| EP | 1 411 475 | A1 | 4/2004 |
| EP | 1 439 495 | A1 | 7/2004 |

* cited by examiner

*Primary Examiner*—Patrick N Edouard
*Assistant Examiner*—Shantell Heiber
(74) *Attorney, Agent, or Firm*—Fraser Clemens Martin & Miller LLC; William J. Clemens

(57) ABSTRACT

A method of controlling access to an area accessible by persons, particularly to a space closed by a door, includes providing a first mobile communications unit on which at least one access code is filed, at least one second mobile communications unit and a receiver unit for receiving the access code. The access code is transmitted by the first communications unit to the second communications unit. The access code is transmitted to the receiver unit by this second communications unit. After a successful checking of the access code by the receiver unit the door access is freed.

12 Claims, 1 Drawing Sheet

METHOD OF CONTROLLING ACCESS TO AN AREA ACCESSIBLE BY PERSONS, PARTICULARLY TO A SPACE CLOSED BY A DOOR

BACKGROUND OF THE INVENTION

The present invention relates to a method of controlling access to an area accessible by persons, particularly to a space closed by a door. For performance of the method a first mobile communications unit on which at least one access code is filed and a receiver unit for receiving the access code are provided. The receiver unit serves for checking the access code and frees access after a successful checking of the access code.

Modern access control systems of buildings are frequently operated by a chipcard on which an electronic key is filed. Apart from this electronic key, user-specific data such as, for example, a personal visit card or the like can also be stored on a chipcard of that kind. In addition, the data on the chipcard can be provided with an expiry date so that use of the chipcard is possible only for a specific period of time. However, the disadvantage exists with a chipcard of that kind, particularly when this forms the sole control authority of the door lock, that the chipcard can be passed on to an unauthorized third party or lost.

Some solutions for this problem are already known from the state of the art. Thus, US published patent application 2002/0180582 A1, for example, describes a method of controlling access to an environment locked by a lock, wherein a first access code is stored in a first memory unit and a second access code is stored in a second memory unit of an electronic key unit. The electronic key unit, which is preferably formed by a mobile telephone, communicates the second access code to a control unit of the lock. The communicated second access code is subsequently compared with the first access code stored in the first memory unit and, if the first access code agrees with the second access code, the lock is released. The mobile telephone is in that case equipped in such a manner that the second memory unit can store a plurality of access codes for a number of buildings. In this way the user can make a selective choice of an access code and communicate this to the control unit of the lock equipment.

It has proved disadvantageous with this known method that the access code stored on the mobile telephone is usable only by a user who is in possession of the mobile telephone and knows the PIN code for switching the mobile telephone to be free. This is usually in that case one and the same person. For this reason the access right in the form of the access code is transmissible to a third party only in the case of handing over the mobile telephone and making known the PIN code to the third party.

SUMMARY OF THE INVENTION

The present invention has the object of so developing a method of controlling access to an area accessible by persons that an access right in the form of an access code can be granted to further authorized persons whilst ensuring security.

According to the present invention for fulfillment of this object in the case of a method of controlling access to an area accessible by persons, particularly to a space closed by a door, with a first mobile communications unit on which at least one access code is filed, with at least one second mobile communications unit and with a receiver unit for receiving the access code, it is provided that the method comprises the following steps:

a) transmitting the access code from the first communications unit to the second communications unit;

b) transmitting the access code from the second communications unit to the receiver unit;

c) checking the access code by the receiver unit; and d) freeing the access if the check is successful.

The method according to the present invention is based on the recognition that through the use of several mobile communications units which are equipped to communicate at least one access code amongst one another and to the receiver unit there is created an access control system in which the transfer of an access right by means of the communications unit carried by the user can take place in simple, but nevertheless secure manner.

Moreover, the method according to the present invention makes it possible for the access code stored on the various communications units to be communicated, for example, by a central computer unit to selected communications units and thus to also be able to be changed or locked during the provided use time period.

A method is provided by the present invention which is preferably used for access control of elevators and buildings, offices, dwellings and individual rooms in units of that kind. A wireless communication between the units is preferably used for communication of the data in the form of code sequences which can comprise, apart from the access codes, further data. A near-field communications system is preferably provided as communications network. This means that the communication between the respective units is possible only within a near field. In this manner it can be ensured that no unauthorized access to the communications network takes place and that there is no possible spying on access codes. The term "unit" in the case of the present invention forms a generic expression for the communications units and the receiver unit.

In an advantageous development of the method it is provided that the access code is transmitted and received only when the mutually communicating units are spaced from one another at a predetermined distance. Advantageously this spacing is less than approximately ten meters, preferably less than approximately one meter. It can thus be provided that the access code can be transmitted from the first communications unit to the second communications unit only when the two communications units are held near one another, for example at a distance of a few centimeters. Conventional interfaces, particularly infrared interfaces, can be used for a wireless, radio-based data transmission of that kind and, in particular, the NFC standard can be used as transmission standard.

In a development of the method according to the present invention it is proposed that the access code is provided with at least one attribute and/or at least one attribute of the access code is changed. Advantageously it is provided in this connection that the attribute is created or changed by the first communications unit or by the second communications unit. In that case, inter alia, a specific running time or a copying protection can be assigned as the attribute. This makes it possible for the access code to be stored in the form of an electronic key on a mobile telephone to be secure against copying and incapable of editing. On the other hand, an attribute can also be provided according to which a restricted number of copies of the electronic key can be created or the electronic key can only be cancelled.

It can be provided as a further safety barrier that the access is freed only within a predetermined period of time. Thus, for example, access for a first group of persons can be allowed only during the day and for a second group of persons only at night. In order to make this possible the receiver unit and/or the mobile communications unit can be appropriately equipped and/or the access code itself can be appropriately generated.

In order to furnish a security measure independent of time, in an advantageous development of the method of the present invention the access code is cancelled after a predetermined number of uses for freeing the access. The cancellation can take place after a single use or multiple uses and either automatically or by an authorized person operating a central computer unit.

For filing the access code on the first communications unit a computer unit generates the access code and communicates this to the first communications unit. In that case the communication by the computer unit to the first communications unit can take place by means of a global, local or near-field communications network. Alternatively, a wire-bound line for data transmission can also be used.

Preferably a mobile telephone is used as the first communications unit and/or the second communications unit. Thus, it is possible to avoid an obligation for the user to carry, apart from his or her mobile telephone, a further mobile communications unit.

In a development of the method according to the present invention it is proposed that the access code is processed by means of the first communications unit and/or by means of the second communications unit. In this manner, for example, an access code of a door lock can be blocked by the mobile communications unit without the receiver unit or a central computer unit having to be operated for this purpose.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
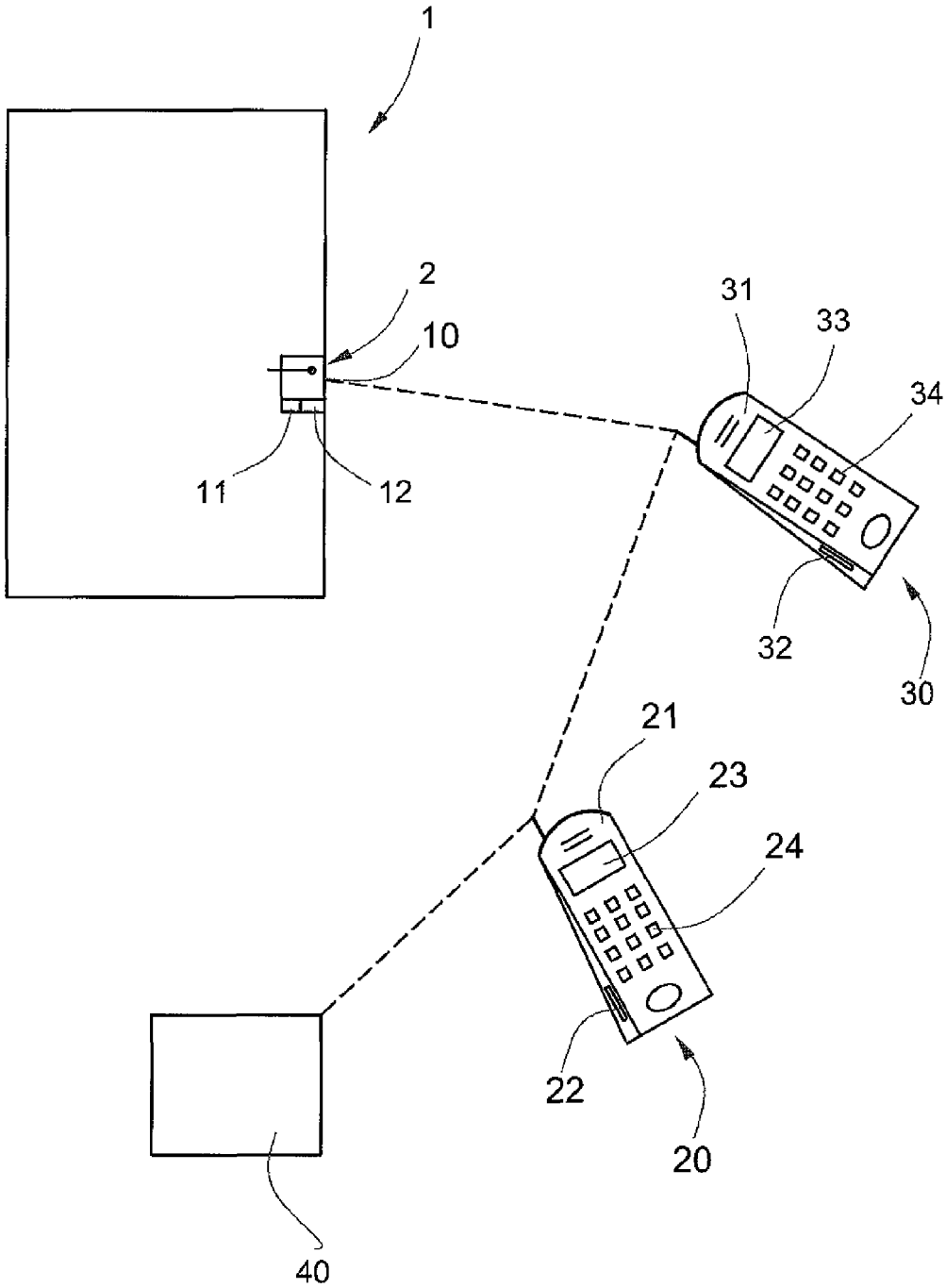
FIG. 1 is a schematic illustration of an access control system according to the present invention.

FIG. 1 schematically shows an access control system for a space closed by a door 1, for example for an elevator. The door 1 is equipped with an electronic door lock 2 and a receiver unit 10. The access control system additionally comprises a first mobile communications unit 20 and a second mobile communications unit 30. For release of the door lock 2 there is necessary an electronic key in the form of an access code which is generated by a central computer unit 40 and communicated to a memory unit 21 of the first communications unit 20.

This access code could now be communicated directly from the first communications unit 20 to the receiver unit 10 of the door lock 2. However, it is preferentially provided that the access code is, for transfer of the access right to another person, transmitted to the second communications unit 30. Before this communication of the access code the user of the first communications unit 20 can selectively process the access code. For this purpose the user selects the desired function, for example "Copy", in a menu by way of a display 23 and a keyboard 24 of the first communications unit 20 and subsequently transmits the copy of the access code to the second communications unit 30 by selection of the function "Transfer". The first communications unit 20 has for transfer of the access code an interface 22 and the second communications unit 30 has an interface 32 for wireless, radio-based data transmission. In this connection the data transfer takes place only when the first communications unit 20 is disposed in a near field of the second communications unit 30 or conversely. For example, the distance between the interfaces 22, 32 amounts to only a few centimeters. The NFC standard is used as transmission standard. The communicated access code is stored in a memory unit 31 of the second communications unit 30.

Within the scope of processing the access code by the first communications unit 20 the access code can be provided with an attribute or an attribute already assigned by the computer unit 40 can be changed. A specific running time or a copying protection is preferably assigned as attribute. It can equally be provided that the second communications unit 30 is authorized to be able to similarly undertake specific changes to the access code.

After successful transfer of the access code from the first communications unit 20 to the second communications unit 30 a release of the door lock 2 can now be achieved by means of the second communications unit 30. For this purpose the second communications unit 30 is held with its interface 32 near an interface 12 of the receiver unit 10 so that a wire-free communication of the access code by means of a near-field network and the NEC standard is possible. The second communications unit 30 has a display 33 and a keyboard 34 for operating the second communications unit 30 by way of a menu guide. After the receiver unit 10 has received the thus-communicated access code and filed it in a memory unit 11 this is compared with an original access code filed by the computer unit 40 in the memory unit 11 of the receiver unit 10. In the case of agreement of the access code with the original access code the receiver unit 10 issues a control signal for release of the door lock 2.

In order to also sufficiently take into account the highest safety requirements the second communications unit 30 and/or the receiver unit 10 can be so equipped that release of the door lock 2 takes place only as long as the second communications unit 30 is located within a specific distance from the receiver unit 10, for example within a near field. Alternatively, the access code can also be programmed so that the door lock 2 is released only within a predetermined period of time or at a specific point in time. In addition, the release of the door lock 2 can also be activated only when not only the first communications unit 20, but also the second communications unit 30 are disposed within a predetermined distance from the receiver unit 10. In order to exclude use of the communications units 20, 30 by unauthorized persons every communication of the access code by one of the units 20, 30 can be secured by an advance PIN code interrogation.

Moreover, the access code for the door lock 2 can be locked by the first communications unit 20 without the central computer unit 40 having to be operated for this purpose. For this purpose the authorized party holds the first communications unit 20 at the receiver unit 10 and selects in the menu the option "Lock" for locking the access code. Thus, another user cannot open the door lock 2 by the second communications unit 30 and the access code filed there.

The described method for access control to a space closed by the door 1 is distinguished particularly by the fact that the electronic key is transferable in the form of an access code from the first communications unit 20 to the second communications unit 30 in simple manner by wireless data transmission, wherein security is guaranteed in that the communications units 20, 30 are usable only after a PIN code interrogation and the data transmission is possible only in a near field.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of controlling access to an area accessible by persons, particularly to a space closed by a door, with a first mobile communications unit on which at least one access code is filed, with at least one second mobile communications unit and with a receiver unit for receiving the access code, wherein the method comprises the following steps:

a) transmitting the access code from the first mobile communications unit to the second mobile communications unit, the access code being transmitted and received only when the mutually communicating first and second mobile communications units are spaced from one another within a predetermined first distance, which first distance is a transmission range of the first mobile communications unit of less than ten meters;

b) transmitting the access code from the second mobile communications unit to the receiver unit, the access code being transmitted and received only when the mutually communicating second mobile communications unit and receiver unit are spaced from one another within a predetermined second distance, which second distance is a transmission range of the second mobile communications unit of less than ten meters;

c) checking the access code by the receiver unit; and d) freeing the access to the area if the check is successful.

2. The method according to claim 1 wherein the access code is provided with at least one attribute or at least one attribute of the access code is changed.

3. The method according to claim 2 wherein a specific running time or a copying protection is assigned as the at least one attribute.

4. The method according to claim 2 wherein the at least one attribute is created or changed by the first mobile communications unit or by the second mobile communications unit.

5. The method according to claim 4 wherein a specific running time or a copying protection is assigned as the at least one attribute.

6. The method according to claim 1 wherein the access is freed only within a predetermined time period.

7. The method according to claim 1 wherein the access code is cancelled after a predetermined number of uses for freeing the access.

8. The method according to claim 1 wherein a computer unit generates the access code and communicates the access code to the first mobile communications unit.

9. The method according to claim 1 wherein a mobile telephone is used as the first mobile communications unit or the second mobile communications unit.

10. The method according to claim 1 wherein the access code is processed by the first mobile communications unit or by the second mobile communications unit.

11. The method according to claim 1 wherein the predetermined first distance is less than one meter.

12. The method according to claim 1 wherein the predetermined second distance is less than one meter.

* * * * *